US008432314B2

(12) United States Patent
Mao et al.

(10) Patent No.: US 8,432,314 B2
(45) Date of Patent: Apr. 30, 2013

(54) ANTENNA ARRAY METHOD FOR ENHANCING SIGNAL TRANSMISSION

(75) Inventors: Shau-Gang Mao, Taipei (TW); Wei-Kung Deng, Taipei (TW)

(73) Assignee: RichWave Technology Corp., NeiHu District, Taipei (TW)

( * ) Notice: Subject to any disclaimer, the term of this patent is extended or adjusted under 35 U.S.C. 154(b) by 389 days.

(21) Appl. No.: 12/784,509

(22) Filed: May 21, 2010

(65) Prior Publication Data

US 2011/0095958 A1 Apr. 28, 2011

(30) Foreign Application Priority Data

Oct. 28, 2009 (TW) ..... 98136494 A

(51) Int. Cl.
*H01Q 1/38* (2006.01)
*H01Q 5/00* (2006.01)
*H01Q 9/04* (2006.01)

(52) U.S. Cl.
USPC ..... 343/700 MS; 343/824; 343/846

(58) Field of Classification Search ..... 343/700 MS, 343/824, 846
See application file for complete search history.

(56) References Cited

U.S. PATENT DOCUMENTS

| | | | | | |
|---|---|---|---|---|---|
| 4,691,206 | A | * | 9/1987 | Shapter et al. | 343/700 MS |
| 4,914,445 | A | * | 4/1990 | Shoemaker | 343/700 MS |
| 4,937,585 | A | * | 6/1990 | Shoemaker | 343/700 MS |
| 5,712,644 | A | | 1/1998 | Kolak | |

FOREIGN PATENT DOCUMENTS

| | | | |
|---|---|---|---|
| CN | 1767262 | A | 5/2006 |
| CN | 101345349 | A | 1/2009 |
| DE | 39 07 606 | A1 | 9/1990 |
| GB | 1 586 305 | | 3/1981 |

* cited by examiner

*Primary Examiner* — Anh Tran
(74) *Attorney, Agent, or Firm* — Winston Hsu; Scott Margo

(57) ABSTRACT

In an antenna array, a metal layer is used for covering a block mapped by micro-strips, which are disposed on an obverse side of a base plate, on a reverse side of the base plate, so as to concentrating energy of radio signals emitted from radiator sets on a predetermined direction. The base plate and elements loaded by the base plate are fabricated according to designed specifications, so as to enhance the concentration of energy of the radio signals on the predetermined direction.

23 Claims, 9 Drawing Sheets

ANTENNA ARRAY METHOD FOR ENHANCING SIGNAL TRANSMISSION

BACKGROUND OF THE INVENTION

1. Field of the Invention

The present invention discloses an antenna array and a method for enhancing signal transmission thereof, and more particularly, to a bi-directional planar antenna array and a method for enhancing signal transmission thereof.

2. Description of the Prior Art

A conventional antenna may be classified as an omni antenna or a beam antenna, according to a distribution of the conventional antenna on a plane. In a free space, an antenna is configured to transmit energy by radiation; however, the antenna may also be designed to transmit energy in a more directional manner by concentrating the transmitted energy on a specific direction. While connecting a plurality of antennas on a same signal source or a same loading, an antenna array may thus be generated, where the connections may be implemented by physical wires, such as micro-strips. In an antenna array, relative positions between antennas may introduce obvious effects in the direction or a gain of transmitting energy. Therefore, antennas included by an antenna array have to be designed delicately and precisely.

SUMMARY OF THE INVENTION

The claimed invention discloses an antenna array. The antenna array comprises a micro-strip set, a plurality of radiator set, and a base plate. The micro-strip set comprises a plurality of micro-strips and a primary micro-strip. The plurality of micro-strips are coupled to the primary micro-strip. Each of the plurality of radiator set comprises a plurality of radiators connected in series through micro-strips. The plurality of radiator sets are coupled to the plurality of micro-strips in a one-by-one correspondence. The base plate comprises a first surface for loading the micro-strip set and the plurality of radiator sets. In each of the plurality of radiator sets, a length of each of the plurality of radiators equals to a half wavelength or a multiple of the half wavelength of a signal transmitted by the micro-strip set.

The claimed invention also discloses a method for enhancing signal transmission. The disclosed method comprises providing a micro-strip set, which comprises a plurality of micro-strips and a primary micro-strip, to an antenna array, wherein the plurality of micro-strips are coupled to the primary micro-strip; providing a plurality of radiator set to the antenna array, each of the plurality of radiator set comprising a plurality of radiators connected in series through micro-strips, wherein the plurality of radiator sets are coupled to the plurality of micro-strips in a one-by-one correspondence; providing a base plate, which comprises a first surface for loading the micro-strip set and the plurality of radiator sets, to the antenna array; and utilizing the antenna array on a radio communication device. In each of the plurality of radiator sets, a length of each of the plurality of radiators equals to a half wavelength or a multiple of the half wavelength of a signal transmitted by the micro-strip set.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 4 illustrates an obverse side of the antenna array, FIG. 5 illustrates a reverse side of the antenna array shown in FIG. 4, and FIG. 6 illustrates a lateral view of the antenna array shown in FIG. 4.

FIG. 7 illustrates an observe side of the antenna array, and FIG. 8 illustrates a reverse side of the antenna array.

DETAILED DESCRIPTION

Figure 1:
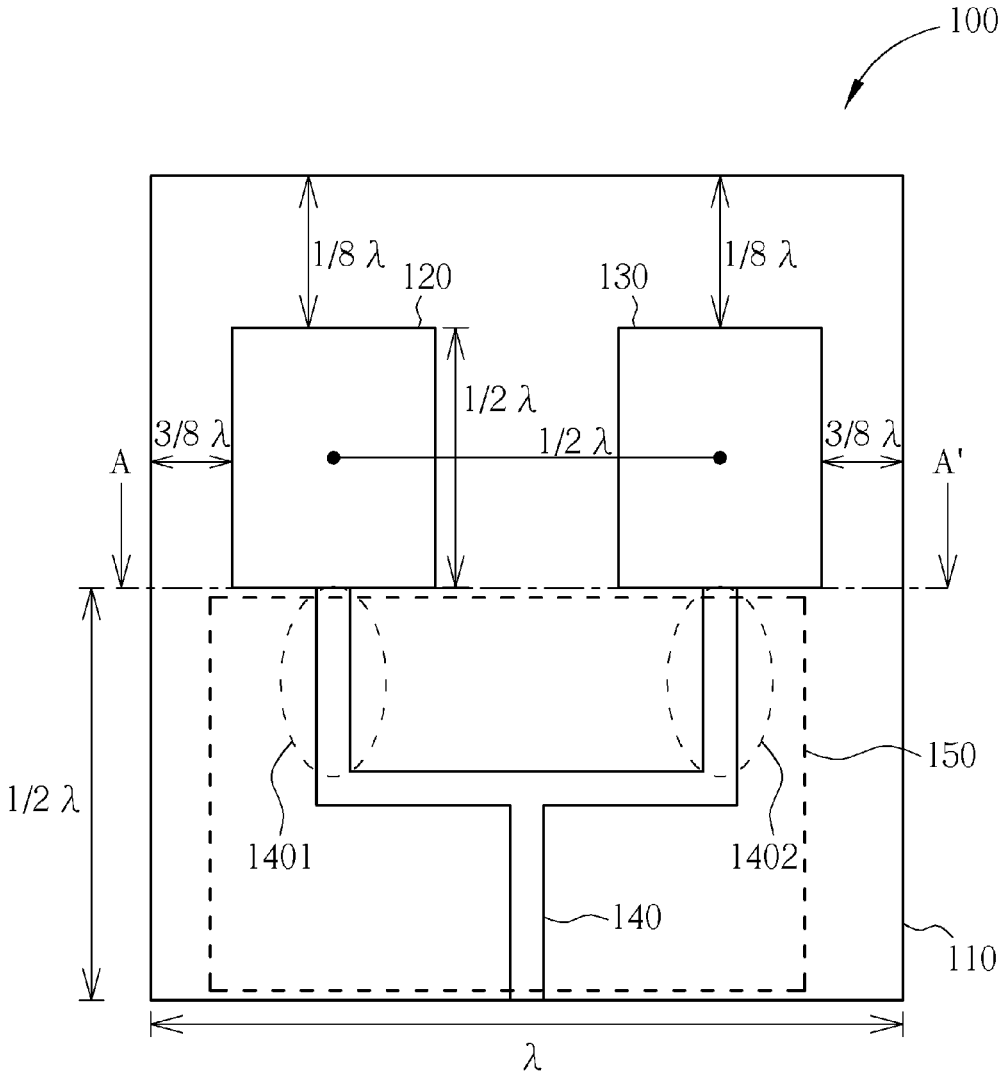
FIG. 1 illustrates an obverse side of an antenna array according to a first embodiment of the present invention.
Figure 2:
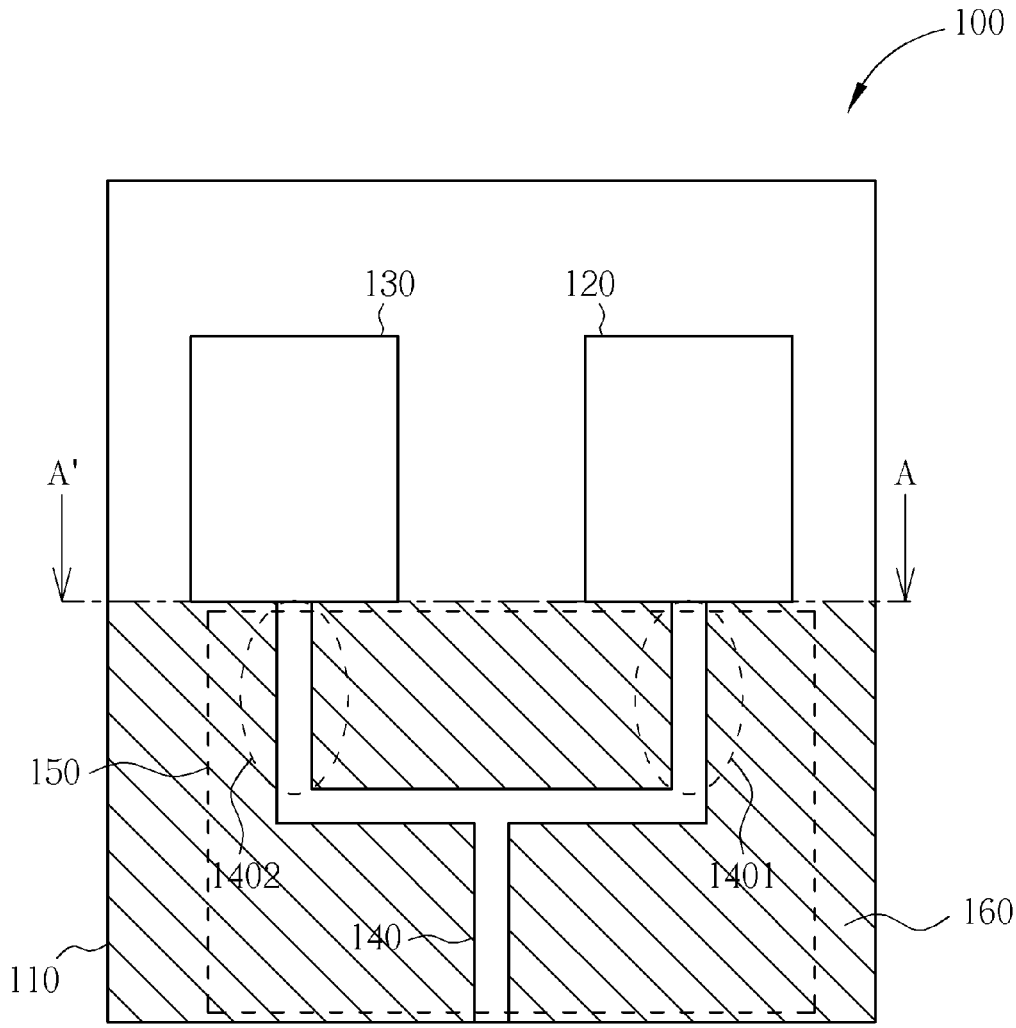
FIG. 2 illustrates a reverse side of the antenna array shown in FIG. 1.
Figure 3:
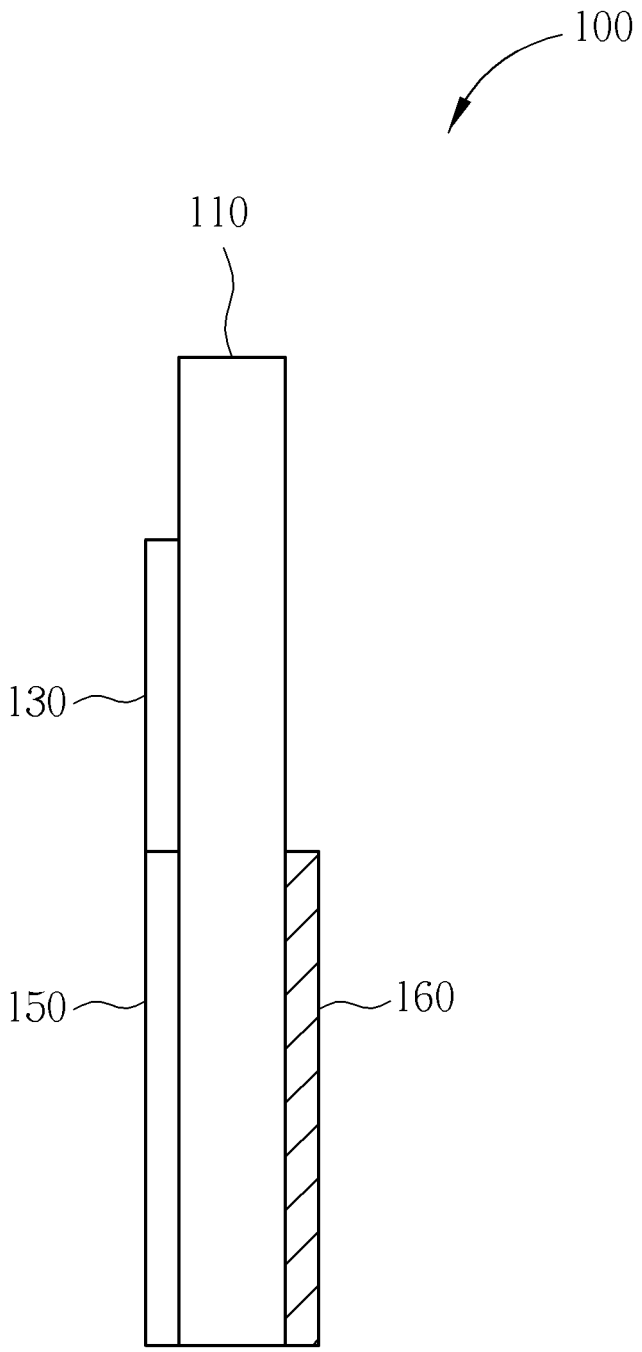
FIG. 3 illustrates a lateral side of the antenna array shown in FIGS. 1-2.

Please refer to FIG. 1, FIG. 2, and FIG. 3. FIG. 1 illustrates an obverse side of a provided antenna array 100 according to a first embodiment of the present invention. Note that the antenna array 100 may be a bi-directional planar antenna array. FIG. 2 illustrates a reverse side of the provided antenna array 100 shown in FIG. 1. FIG. 3 illustrates a lateral side of the provided antenna array 100 shown in FIGS. 1-2. As shown in FIG. 1, the antenna array 100 includes a base plate 110, a first radiator 120, a second radiator 130, and a micro-strip set 150. The base plate 110 loads the first radiator 120, the second radiator 130, and the micro-strip set 150. Both the first radiator 120 and the second radiator 130 are aligned in parallel along both lateral sides of the base plate 110. The micro-strip set 150 includes a primary micro-strip 140 and two micro-strips 1401 and 1402, where both the micro-strips 1401 and 1402 are coupled to the primary micro-strip 140. The first radiator 120 is coupled to the micro-strip 1401, and the second radiator 130 is coupled to the micro-strip 1402. The primary micro-strip 140 receives signals provided from external, and transmits the signals to each of the first radiator 120 and the second radiator 130 through the micro-strips 1401 and 1402 respectively. Impedance formed by the first radiator 120 and the second radiator 130 is complex conjugate matched to the impedance formed by the micro-strip set 150.

In FIG. 1 and FIG. 2, a hatch AA' is used for differentiating the obverse side shown in FIG. 1 from the reverse side shown in FIG. 2 of the antenna array 100. As shown in FIG. 2 and FIG. 3, a metal layer 160 covers a block mapped by the micro-strip set 150 on the reverse side of the antenna array 100, where the metal layer 160 does not overlap with blocks mapped by both the first radiator 120 and the second radiator 130 on the reverse side of the antenna array 100. Note that the block covered by the metal layer 160 on the reverse side of the antenna array 100 is indicated with italic lines. Moreover, in FIG. 3, thicknesses of the second radiator 130, the micro-strip set 150, and the metal layer 160 may be negligible with respect to a thickness of the antenna array 100. The metal layer 160 helps in blocking radio signals from the first radiator 120 and the second radiator 130 from emitting towards the reverse side of the antenna array 100, and helps in raising a degree of concentrating emitted energy of radio signals on a specific direction. Note that the metal layer 160 may be directly adhered, electroplated, or coated on the reverse side of the base plate 110.

Suppose that a wavelength of the radio signals emitted by the micro-strip set 150 is λ, as shown in FIG. 1, a distance between the first radiator 120 and the second radiator 130 may be $$\frac{1}{2}\lambda,$$

and in other embodiments of the present invention, the distance between the first radiator 120 and the second radiator 130 may be a multiple of $$\frac{1}{2}\lambda.$$

Besides, a length of bottom of the base plate 110 may be λ or a multiple of λ. A distance between the first radiator 120 and one lateral side of the base plate 110 is $$\frac{3}{8}\lambda,$$

and a distance between the second radiator 130 and another lateral side of the base plate 110 is $$\frac{3}{8}\lambda$$

as well. A distance between the first radiator 120 and top of the base plate 110 is $$\frac{1}{8}\lambda,$$

and a distance between the second radiator 130 and top of the base plate 110 is $$\frac{1}{8}\lambda$$

as well.

Lengths of both lateral sides of the base plate 110 are related to the disposition of the metal layer 160. As can be observed from FIG. 1 and FIG. 2, the metal layer 160 shields part of the reverse side of the base plate 110 without shielding the reverse side of the radiators, so as to prevent itself from blocking a predetermined direction of transmitting the radio signals. As can be seen from FIG. 1 and FIG. 2, the metal layer 160 occupies lengths on both the lateral sides of the base plate 110 by $$\frac{1}{2}\lambda$$

or a multiple of $$\frac{1}{2}\lambda.$$

A length occupied by each of the radiators on both the lateral sides of the base plate 110 also equals to $$\frac{1}{2}\lambda$$

or a multiple of $$\frac{1}{2}\lambda.$$

Besides, a distance between top of the base plate 110 and each of the first radiator 120 and the second radiator 130 equals to $$\frac{1}{8}\lambda,$$

therefore, lengths of both the lateral sides of the base plate 110 may be $$\frac{1}{8}\lambda$$

plus a multiple of $$\frac{1}{2}\lambda.$$

Note that lengths of both the lateral sides of the base plate 110 have to be longer than lengths of the metal layer 160 in occupying both the lateral sides of the base plate 110, since distribution of the metal layer 160 on the base plate 110 cannot be beyond the base plate 110 itself.

In FIG. 1 and FIG. 2, though merely one pair of radiators are illustrated, in other embodiments of the present invention, the radiators 120 and 130 may be respectively replaced by a first radiator set and a second radiator set, where each of the radiator sets includes a plurality of radiators connected in series with the aid of micro-strips, and there is a one-by-one correspondence between radiators of the first radiator set and radiators of the second radiator set. Besides, in certain embodiments of the present invention, an amount of utilized radiator sets may be more than two.

Figure 4:
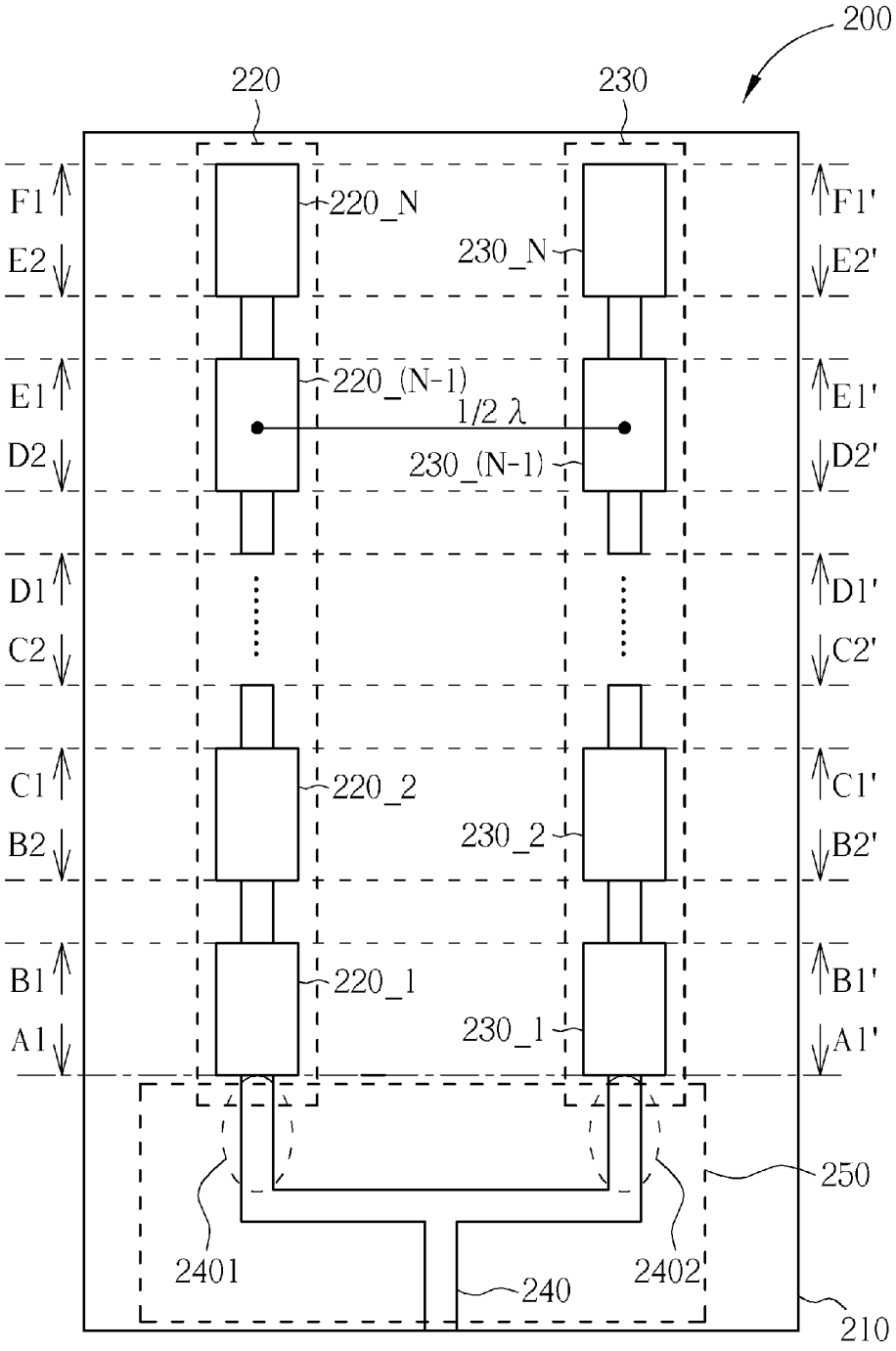
FIG. 4, FIG. 5, and FIG. 6 illustrate an antenna array by replacing the radiators shown in FIG. 1 with radiator sets respectively according to an embodiment of the present invention, where
Figure 5:
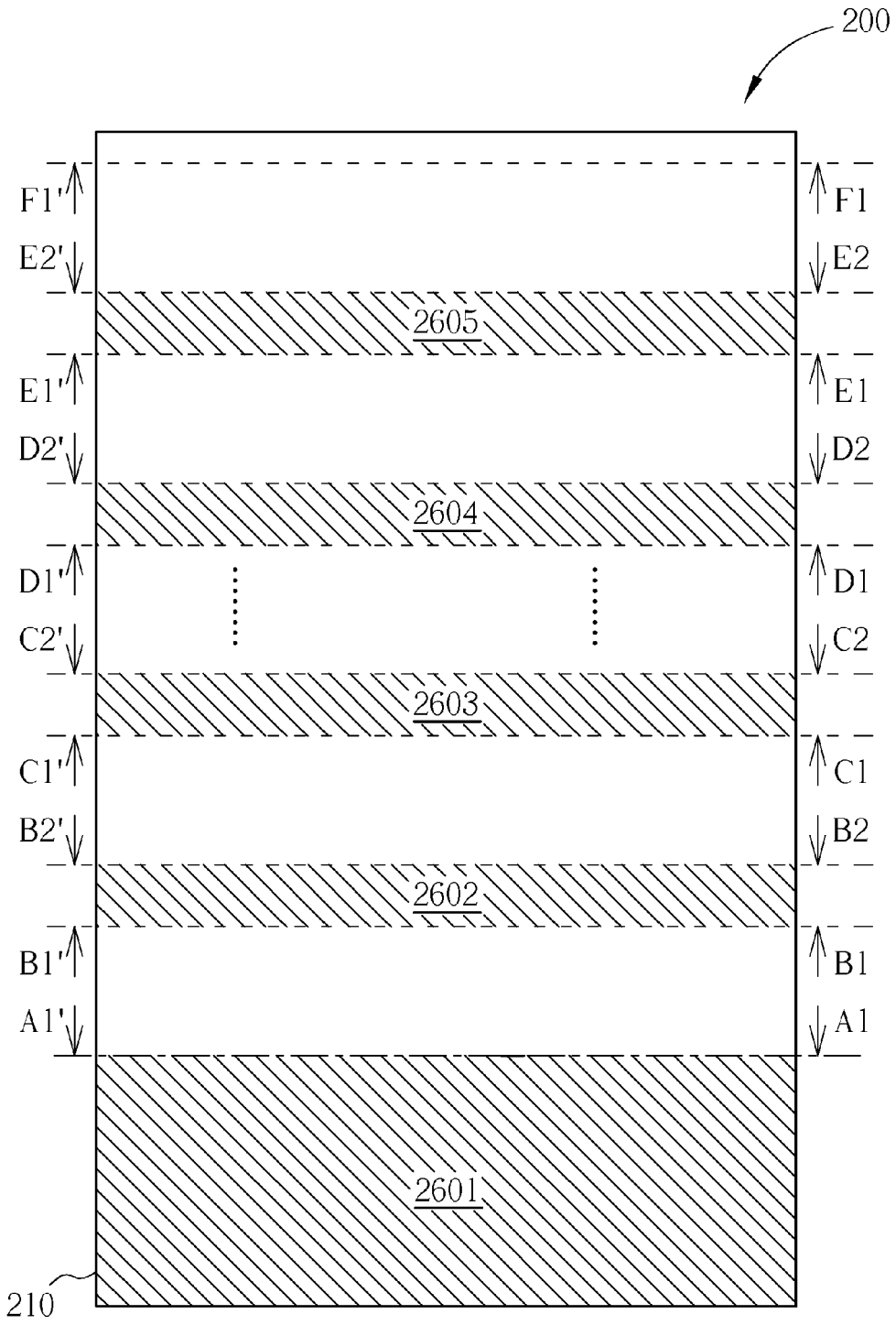
Figure 6:
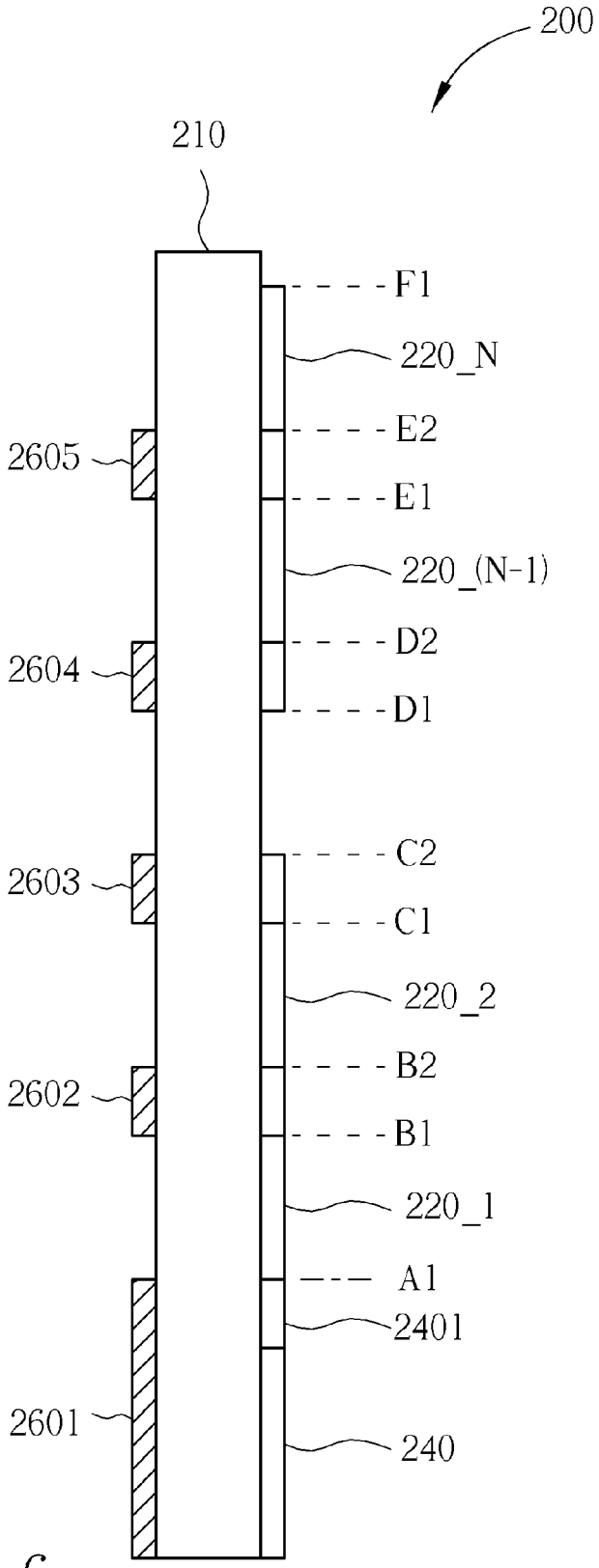

Please refer to FIG. 4, FIG. 5, and FIG. 6, which illustrate an antenna array 200 by replacing the radiators 120 and 130 shown in FIG. 1 with radiator sets respectively according to an embodiment of the present invention. Note that FIG. 4 illustrates an obverse side of the antenna array 200, FIG. 5 illustrates a reverse side of the antenna array 200 shown in FIG. 4, and FIG. 6 illustrates a lateral view of the antenna array 200 shown in FIG. 4. As shown in FIG. 4, the antenna array 200 includes a base plate 210, a first radiator set 220, a second radiator set 230, and a micro-strip set 250. The base plate 210 loads the first radiator set 220, the second radiator set 230, and the micro-strip set 250. The first radiator set 220 and the second radiator set 230 are aligned along both lateral sides of the base plate 210 in parallel. The micro-strip set 250 includes a primary micro-strip 240 and two micro-strips 2401 and 2402. The micro-strips 2401 and 2402 respectively are coupled to the primary micro-strip 240. The first radiator set 220 is coupled to the micro-strip 2401, and the second radiator set 230 is coupled to the micro-strip 2402. The first radiator set 220 includes a plurality of first radiators 220_1, 220_2, . . . , 220_(N−1), 220_N connected in series with the aid of micro-strips. The second radiator set 230 also includes a plurality of first radiators 230_1, 230_2, . . . , 230_(N−1), 230_N connected in series with the aid of micro-strips. The first radiator 2201 corresponds to the second radiator 2301, the first radiator 2202 corresponds to the second radiator 2302, . . . , the first radiator 2203 corresponds to the second radiator 2203, the first radiator 2204 corresponds to the second radiator 2204, and etc. . . . In other words, the plurality of first radiators included by the first radiator set 220 correspond to the plurality of radiators included by the second radiator set 230 in a one-by-one correspondence and form a plurality of pairs. Besides, a distance between a pair of a first radiator and a second radiator equals to $$\frac{1}{2}\lambda$$

or a multiple of $$\frac{1}{2}\lambda.$$

In FIG. 4, FIG. 5, and FIG. 6, hatches A1A1', B1B1', B2B2', C1C1', C2C2', D1D1', D2D2', E1E1', E2E2', F1F1' are illustrated for differentiating the obverse side of the base plate 210 from the reverse side of the base plate 210. As can be observed from FIG. 5 and FIG. 6, there are a plurality of metal layers 2601, 2602, 2603, . . . , 2604, and 2605 distributed on the reverse side of the base plate 210, where the metal layer 2601 covers a block mapped by the micro-strip set 250 on the reverse side of the base plate 210. Note that among the first radiator set 220 and the second radiator set 230, a micro-strip is used for connecting two neighboring first radiators or two neighboring second radiators in series. Besides, since the plurality of first radiators included by the first radiator set 220 and the plurality of second radiators included by the second radiator set 230 have one-by-one correspondence in between, the plurality of micro-strips for connecting the plurality of first radiators in series and the plurality of micro-strips for connecting the plurality of second radiators in series have one-by-one correspondence as well, where a block mapped by a pair of mutual-corresponding micro-strips on the reverse side of the base plate 210 are covered by one of the metal layers 2602, 2603, . . . , 2604, and 2605. Besides, metal layers other than the metal layer 2601 are used for covering blocks mapped by micro-strips for connecting radiators on the reverse side of the base plate 210, so as to concentrate the energy of radio signals on a predetermined direction. However, in certain embodiments of the present invention, the energy of the radio signals is also highly-concentrated at the predetermined direction without using the metal layers 2602, . . . , and 2605. Note that since a total impedance of the radiator sets 220 and 230 is complex conjugate matched to a total impedance of the micro-strip set 250, and impedance matching between the micro-strip set 250 and both the radiator sets 220 and 230 is formed as a result.

Figure 7:
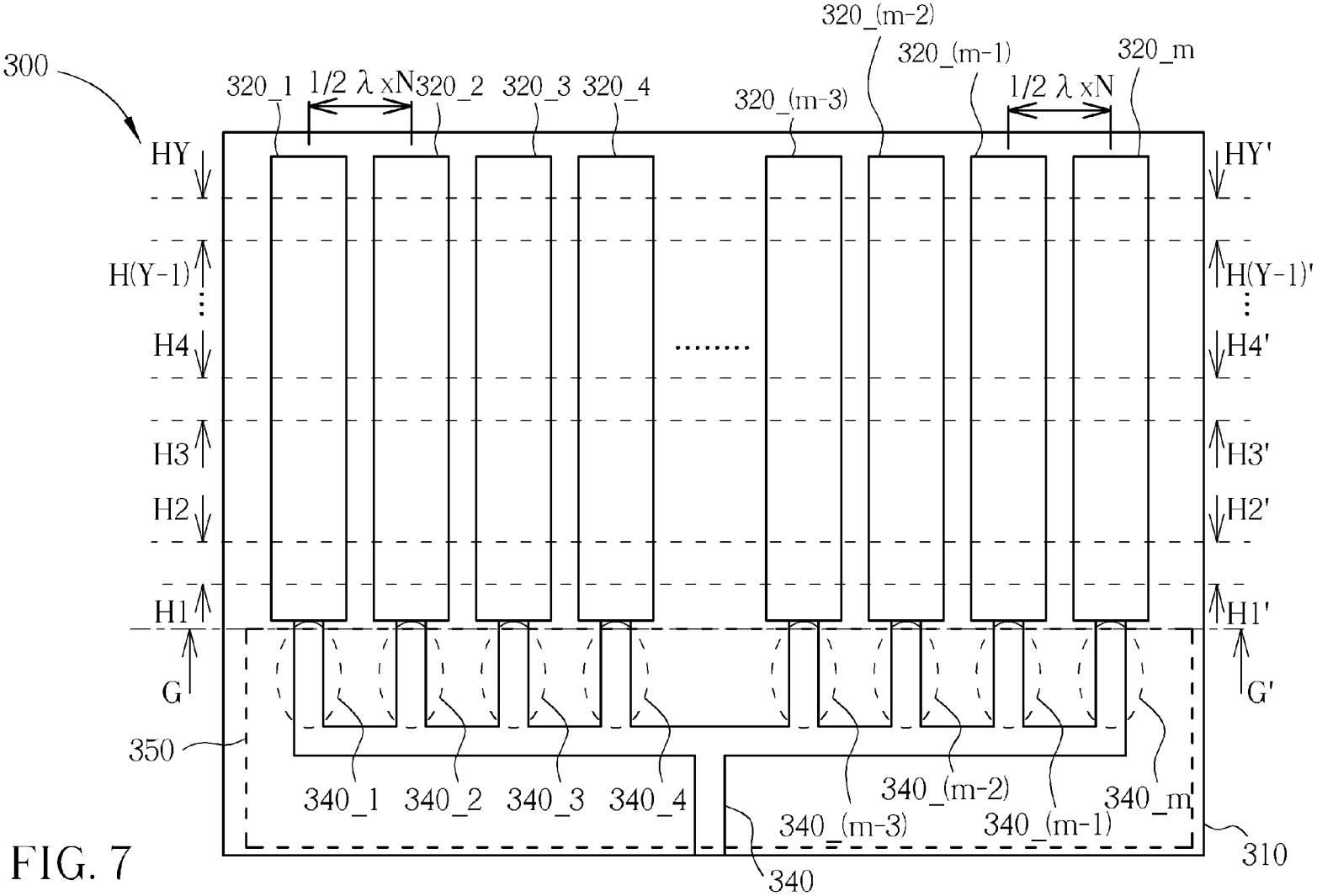
FIG. 7 and FIG. 8 illustrate an antenna array formed by increasing the amount of utilized radiator sets shown in FIG. 4, where
Figure 8:
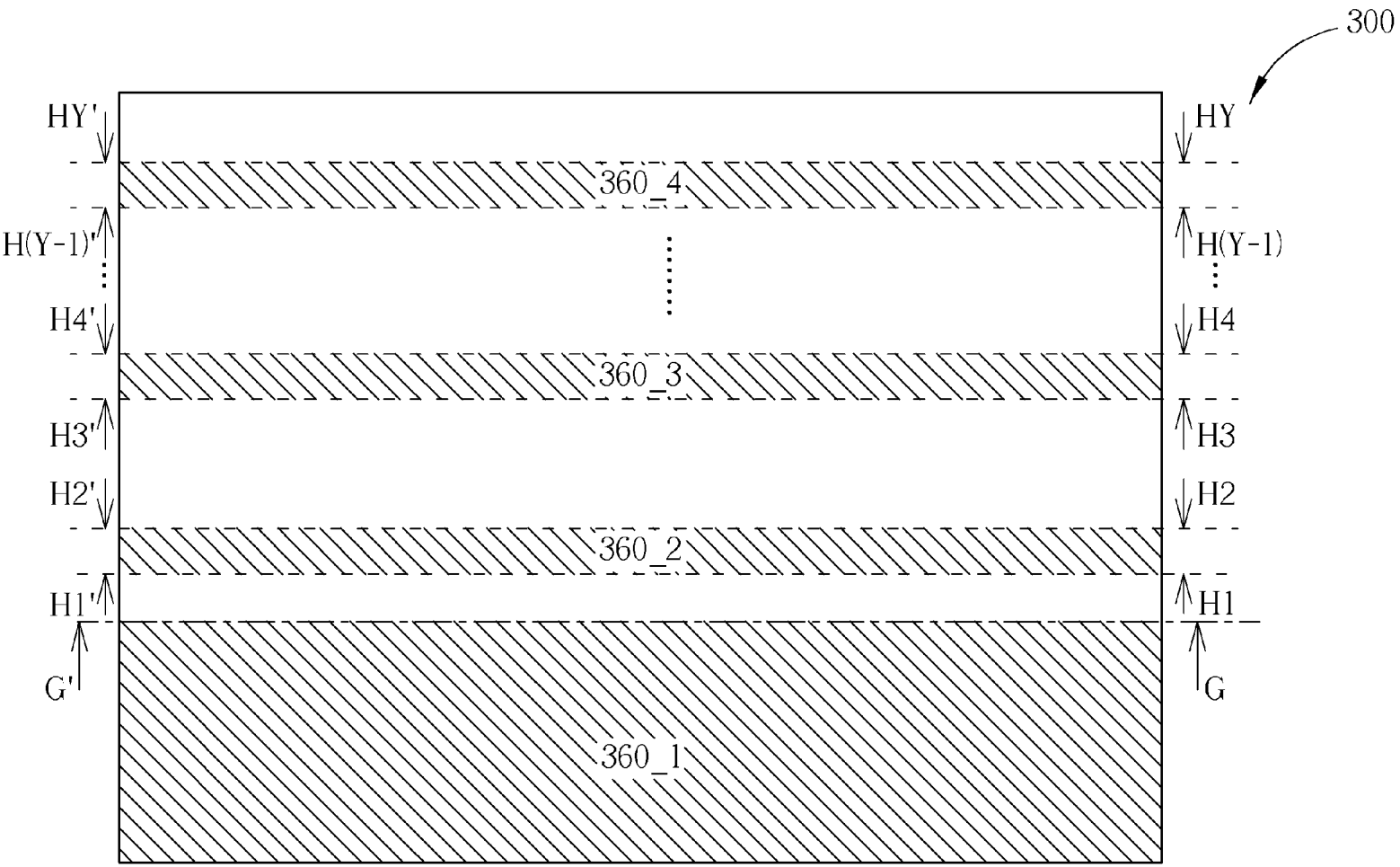
Figure 9:
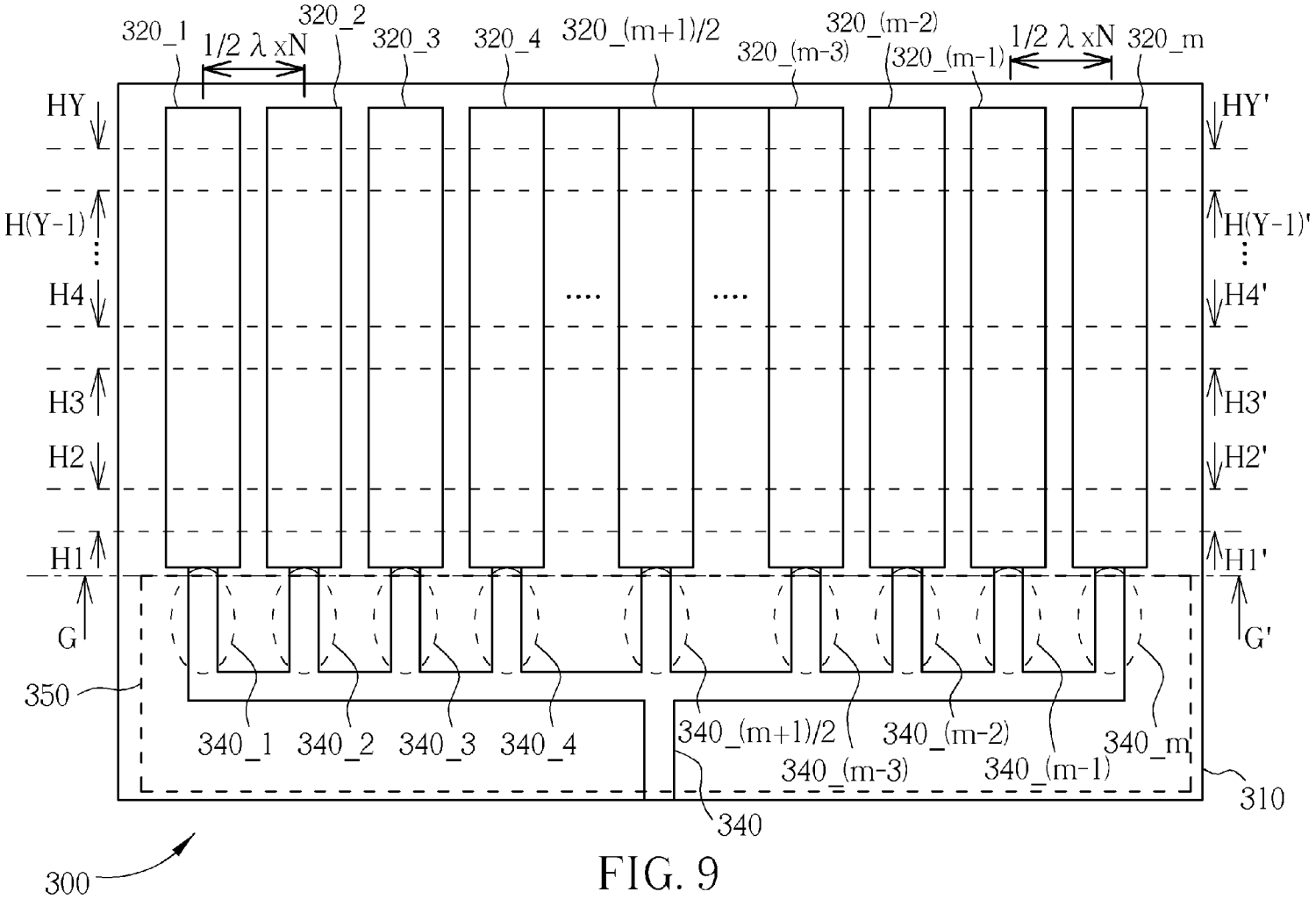
FIG. 9 illustrates a condition that there are odd radiator sets in the antenna array shown in FIG. 7, and there is a unique radiator set disposed at the center of the plurality of radiator sets without forming a pair with the other radiator sets.

Please refer to FIG. 7 and FIG. 8, which illustrate an antenna array 300 formed by increasing the amount of utilized radiator sets shown in FIG. 4, where FIG. 7 illustrates an observe side of the antenna array 300, and FIG. 8 illustrates a reverse side of the antenna array 300. As shown in FIG. 7, the antenna array 300 includes a base plate 310, a plurality of radiator sets 320_1, 320_2, 320_3, 320_4, . . . , 320_(m−3), 320_(m−2), 320_(m−1), 320_m, and a micro-strip set 350. The plurality of radiator sets 320_1, 320_2, 320_3, 320_4, . . . , 320_(m−3), 320_(m−2), 320_(m−1), and 320_m are aligned along both lateral sides of the base plate 310 in parallel. The micro-strip set 350 includes a primary micro-strip 340 and a plurality of micro-strips 340_1, 340_2, 340_3, 340_4, . . . , 340_(m−3), 340_(m−2), 340_(m−1), 340_m, where the plurality of micro-strips 340_1, 340_2, 340_3, 340_4, . . . , 340_(m−3), 340_(m−2), 340_(m−1), 340_m are respectively coupled to the primary micro-strip 340 and the plurality of radiator sets 320_1, 320_2, 320_3, 320_4, . . . , 320_(m−3), 320_(m−2), 320_(m−1), and 320_m. Each of the radiator sets 320_1, 320_2, 320_3, 320_4, . . . , 320_(m−3), 320_(m−2), 320_(m−1), 320_m may be a multiple of $$\frac{1}{4}\lambda \text{ or } \frac{1}{4}\lambda$$

in length, or may be similar with the radiator sets 220 and 230 shown in FIG. 2 in length as well, so that the lengths of the radiator sets 320_1, 320_2, 320_3, 320_4, . . . , 320_(m−3), 320_(m−2), 320_(m−1), 320_m are not illustrated in FIG. 7 for clearance. Note that though the radiator sets radiator sets 320_1, 320_2, 320_3, 320_4, . . . , 320_(m−3), 320_(m−2), 320_(m−1), 320_m shown in FIG. 7 are disposed in pairs, an additional radiator set, such as the radiator set $$320_\frac{(m+1)}{2}$$

shown in FIG. 9, may be disposed at a center of the radiator sets 320_1, 320_2, 320_3, 320_4, . . . , 320_(m−3), 320_(m−2), 320_(m−1), 320_m in an other embodiment of the present invention. Under the condition shown in FIG. 7, the value of m is even so that the radiator sets 320_1, 320_2, 320_3, 320_4, . . . , 320_(m−3), 320_(m−2), 320_(m−1), 320_m may be disposed as pairs. Under the condition shown in FIG. 9, the value of m is odd, therefore, except for the radiator set $$320_\frac{(m+1)}{2}$$

disposed at the center of the radiator sets 320_1, 320_2, 320_3, 320_4, . . . , 320_(m−3), 320_(m−2), 320_(m−1), 320_m, the other radiator sets are also disposed in pairs, where a distance between the center radiator set $$320_\frac{(m+1)}{2}$$

and each of its neighboring radiator sets equals to a multiple of $$\frac{1}{2}\lambda.$$

For example, in FIG. 7 and while the value m is even, the radiator sets 320_1 and 320_2 form a pair, the radiator sets 320_3 and 320_4 form a pair, the radiator sets 320_(m−3) and 320_(m−2) form a pair, and the radiator set 320_(m−1) and 320_m form a pair; on the contrary, in FIG. 9 and while the value m is odd, the radiator set is $$320_\frac{(m+1)}{2}$$

the unique radiator set that does not belong to any pair. Besides, a distance between a pair of radiator sets shown in FIG. 7 and FIG. 9 equals to $$\frac{1}{2}\lambda$$

or a multiple of $$\frac{1}{2}\lambda.$$

In FIG. 7, FIG. 8, and FIG. 9, hatches H1H1', H2H2', H3H3', H4H4', . . . , H(Y−1)H(Y−1)', and HYHY' are illustrated for differentiating the obverse side of the base plate 310 from the reverse side of the base plate 310. As can be observed from FIG. 8, a plurality of metal layers 360_1, 360_2, 360_3, . . . , and 360_X are disposed on the reverse side of the base plate 310 corresponding to blocks mapped by the micro-strip set 350 on the reverse side of the base plate 310, where the metal layer 360_1 covers a block mapped by the micro-strip set 350 on the reverse side of the base plate 310. Similar with as shown in FIG. 5, the meta layers 360_2, 360_3, . . . , 360_X respectively cover blocks mapped by micro-strips used for connecting the plurality of radiator sets 320_1, 320_2, . . . , 320_(m−1), 320_m, which are not shown in FIG. 8 for clearance, in series. Note that as mentioned before, the energy of radio signals from the antenna array 300 is kept on primarily concentrating on a predetermined direction without using the metal layers 360_2, 360_3, . . . , 360_X. Besides, impedance formed by the plurality of radiator sets 320_1, 320_2, . . . , 320_(m−1), and 320_m is complex conjugate matched to the impedance of the micro-strip set 350, so that impedance matching is introduced between the micro-strip set 350 and the plurality of radiator sets 320_1, 320_2, . . . , 320_(m−1), and 320_m.

Note that specifications of elements of both the antenna arrays 200 and 300 are similar or the same with specifications described in FIG. 1 so that the specifications are not repeatedly described for brevity.

The method for enhancing signal transmission may be directly inducted by providing elements and giving the above-mentioned conditions introduced in descriptions related to FIGS. 1-9, so that repeated descriptions for the disclosed method are saved for brevity.

The present invention discloses antenna arrays for concentrating energy of emitted radio signals on a predetermined direction, and disclosed a related method for enhancing signal transmission as well so as to apply the disclosed antenna arrays on radio communication devices. In the disclosed antenna arrays, metal layers are used for covering blocks mapped by micro-strips on a reverse side of a base plate for concentrating energy of radio signals emitted from the antenna array on a predetermined direction. Moreover, the base plate and elements loaded by the base plate are fabricated according to designed specifications, so as to enhance the concentration of energy of the radio signals. According to the disclosed method, the disclosed antenna arrays may be implemented on a radio communication device, such as a transmitter, a receiver, and/or a cell phone.

Those skilled in the art will readily observe that numerous modifications and alterations of the device and method may be made while retaining the teachings of the invention.

What is claimed is:

1. An antenna array, comprising:

a micro-strip set, comprising a plurality of micro-strips and a primary micro-strip, wherein the plurality of micro-strips are coupled to the primary micro-strip;

a plurality of radiator set, each of the plurality of radiator set comprising a plurality of radiators connected in series through micro-strips, wherein the plurality of radiator sets are coupled to the plurality of micro-strips in a one-by-one correspondence;

a base plate, comprising a first surface for loading the micro-strip set and the plurality of radiator sets; and a first metal layer, disposed on a second surface of the base plate, wherein lengths of two lateral sides of the first metal layer equal to the half wavelength of a signal transmitted by the micro-strip set or a multiple of the half wavelength of the signal;

wherein in each of the plurality of radiator sets, a length of each of the plurality of radiators equals to a half wavelength or a multiple of the half wavelength of the signal;

wherein the second surface is disposed on a reverse side to the first surface, and the first metal layer covers on the second surface in correspondence to the micro-strip set; and wherein the first metal layer does not overlap with a block mapped by the plurality of radiator sets on the second surface.

2. The antenna array of claim 1, further comprising:

a plurality of second metal layers, disposed on the second surface;

wherein the plurality of second metal layers cover blocks mapped by the micro-strips, which are used for serially connecting the plurality of radiators, in a one-by-one correspondence and on the second surface;

wherein the second metal layer does not overlap with the blocks mapped by the plurality of radiator sets on the second surface.

3. The antenna array of claim 1, wherein the plurality of radiator sets are disposed as pairs; and wherein a plurality of radiator sets respectively included by a pair of the radiator sets corresponds to each other in a one-by-one correspondence, and a distance between a pair of radiators from each of the pair of radiator sets equals to a half wavelength of the signal or an at-least-two multiple of the half wavelength of the signal.

4. The antenna array of claim 1, wherein impedance formed by the plurality of radiator sets is conjugate matched to the impedance formed by the micro-strip set, to obtain impedance matching condition.

5. An antenna array, comprising:

a micro-strip set, comprising a plurality of micro-strips and a primary micro-strip, wherein the plurality of micro-strips are coupled to the primary micro-strip;

a plurality of radiator set, each of the plurality of radiator set comprising a plurality of radiators connected in series through micro-strips, wherein the plurality of radiator sets are coupled to the plurality of micro-strips in a one-by-one correspondence; and a base plate, comprising a first surface for loading the micro-strip set and the plurality of radiator sets;

wherein in each of the plurality of radiator sets, a length of each of the plurality of radiators equals to a half wavelength or a multiple of the half wavelength of a signal transmitted by the micro-strip set;

wherein a length of a lower edge of the base plate equals to the wavelength of the signal or a multiple of the wavelength;

wherein the plurality of radiator sets are aligned in parallel along both lateral sides of the base plate;

wherein a distance between each of two of the plurality of radiator sets closest to lateral sides of the base plate and the corresponding lateral side equals to three-eighth of the wavelength of the signal; and wherein a distance between a radiator of each of the plurality of radiator sets closest to the top side of the base plate and the top side of the base plate equals to one-eighth of the wavelength of the signal.

6. The antenna array of claim 5, wherein the plurality of radiator sets are disposed as pairs; and wherein a plurality of radiator sets respectively included by a pair of the radiator sets corresponds to each other in a one-by-one correspondence, and a distance between a pair of radiators from each of the pair of radiator sets equals to a half wavelength of the signal or an at-least-two multiple of the half wavelength of the signal.

7. The antenna array of claim 5, wherein impedance formed by the plurality of radiator sets is conjugate matched to the impedance formed by the micro-strip set, to obtain impedance matching condition.

8. An antenna array, comprising:

a micro-strip set, comprising a plurality of micro-strips and a primary micro-strip, wherein the plurality of micro-strips are coupled to the primary micro-strip;

a plurality of radiator set, each of the plurality of radiator set comprising a plurality of radiators connected in series through micro-strips, wherein the plurality of radiator sets are coupled to the plurality of micro-strips in a one-by-one correspondence; and a base plate, comprising a first surface for loading the micro-strip set and the plurality of radiator sets;

wherein in each of the plurality of radiator sets, a length of each of the plurality of radiators equals to a half wavelength or a multiple of the half wavelength of a signal transmitted by the micro-strip set;

wherein the plurality of radiator sets includes a first radiator set and a plurality of second radiator sets disposed in pairs;

wherein radiators included by a pair of the second radiator sets are corresponding in a one-by-one correspondence, and a distance between the pair of second radiator sets equals to a half wavelength of the signal or an at-least-two multiple of the half wavelength of the signal; and wherein the first radiator set is disposed at the center of the plurality of second radiator sets, and a distance between the first radiator set and each of two second radiator sets, which are closest to the first radiator set among the plurality of second radiator sets, equals to an at-least-two multiple of the half wavelength of the signal.

9. The antenna array of claim 8, wherein the plurality of radiator sets are disposed as pairs; and wherein a plurality of radiator sets respectively included by a pair of the radiator sets corresponds to each other in a one-by-one correspondence, and a distance between a pair of radiators from each of the pair of radiator sets equals to a half wavelength of the signal or an at-least-two multiple of the half wavelength of the signal.

10. The antenna array of claim 8, wherein impedance formed by the plurality of radiator sets is conjugate matched to the impedance formed by the micro-strip set, to obtain impedance matching condition.

11. A method for enhancing signal transmission of a radio communication device, comprising:

providing a micro-strip set, which comprises a plurality of micro-strips and a primary micro-strip, to an antenna array, wherein the plurality of micro-strips are coupled to the primary micro-strip;

providing a plurality of radiator set to the antenna array, each of the plurality of radiator set comprising a plurality of radiators connected in series through micro-strips, wherein the plurality of radiator sets are coupled to the plurality of micro-strips in a one-by-one correspondence;

providing a base plate, which comprises a first surface for loading the micro-strip set and the plurality of radiator sets, to the antenna array;

providing a first metal layer, which is disposed on a second surface of the base plate, to the radio communication device, wherein lengths of two lateral sides of the first metal layer equal to the half wavelength of a signal transmitted by the micro-strip set or a multiple of the half wavelength of the signal; and utilizing the antenna array on a radio communication device;

wherein in each of the plurality of radiator sets, a length of each of the plurality of radiators equals to a half wavelength or a multiple of the half wavelength of the signal;

wherein the second surface is disposed on a reverse side to the first surface, and the first metal layer covers on the second surface in correspondence to the micro-strip set; and wherein the first metal layer does not overlap with a block mapped by the plurality of radiator sets on the second surface.

12. The method of claim 11, further comprising:

providing a plurality of second metal layers, which are disposed on the second surface, to the radio communication device;

wherein the plurality of second metal layers cover blocks mapped by the micro-strips, which are used for serially connecting the plurality of radiators, in a one-by-one correspondence and on the second surface;

wherein the second metal layer does not overlap with the blocks mapped by the plurality of radiator sets on the second surface.

13. The method of claim 11, wherein the plurality of radiator sets are disposed as pairs; and wherein a plurality of radiator sets respectively included by a pair of the radiator sets corresponds to each other in a one-by-one correspondence, and a distance between a pair of radiators from each of the pair of radiator sets equals to a half wavelength of the signal or an at-least-two multiple of the half wavelength of the signal.

14. The method of claim 11, wherein impedance formed by the plurality of radiator sets is conjugate matched to the impedance formed by the micro-strip set, to obtain impedance matching condition.

15. The method of claim 11 wherein the communication device is a transmitter, a receiver, and/or a cell phone.

16. A method for enhancing signal transmission of a radio communication device, comprising:

providing a micro-strip set, which comprises a plurality of micro-strips and a primary micro-strip, to an antenna array, wherein the plurality of micro-strips are coupled to the primary micro-strip;

providing a plurality of radiator set to the antenna array, each of the plurality of radiator set comprising a plurality of radiators connected in series through micro-strips, wherein the plurality of radiator sets are coupled to the plurality of micro-strips in a one-by-one correspondence;

providing a base plate, which comprises a first surface for loading the micro-strip set and the plurality of radiator sets, to the antenna array; and utilizing the antenna array on a radio communication device;

wherein in each of the plurality of radiator sets, a length of each of the plurality of radiators equals to a half wavelength or a multiple of the half wavelength of a signal transmitted by the micro-strip set;

wherein a length of a lower edge of the base plate equals to the wavelength of the signal or a multiple of the wavelength;

wherein the plurality of radiator sets are aligned in parallel along both lateral sides of the base plate;

wherein a distance between each of two of the plurality of radiator sets closest to lateral sides of the base plate and the corresponding lateral side equals to three-eighth of the wavelength of the signal; and wherein a distance between a radiator of each of the plurality of radiator sets closest to the top side of the base plate and the top side of the base plate equals to one-eighth of the wavelength of the signal.

17. The method of claim 16, wherein the plurality of radiator sets are disposed as pairs; and wherein a plurality of radiator sets respectively included by a pair of the radiator sets corresponds to each other in a one-by-one correspondence, and a distance between a pair of radiators from each of the pair of radiator sets equals to a half wavelength of the signal or an at-least-two multiple of the half wavelength of the signal.

18. The method of claim 16, wherein impedance formed by the plurality of radiator sets is conjugate matched to the impedance formed by the micro-strip set, to obtain impedance matching condition.

19. The method of claim 16, wherein the communication device is a transmitter, a receiver, and/or a cell phone.

20. A method for enhancing signal transmission of a radio communication device, comprising:

providing a micro-strip set, which comprises a plurality of micro-strips and a primary micro-strip, to an antenna array, wherein the plurality of micro-strips are coupled to the primary micro-strip;

providing a plurality of radiator set to the antenna array, each of the plurality of radiator set comprising a plurality of radiators connected in series through micro-strips, wherein the plurality of radiator sets are coupled to the plurality of micro-strips in a one-by-one correspondence;

providing a base plate, which comprises a first surface for loading the micro-strip set and the plurality of radiator sets, to the antenna array; and utilizing the antenna array on a radio communication device;

wherein in each of the plurality of radiator sets, a length of each of the plurality of radiators equals to a half wavelength or a multiple of the half wavelength of a signal transmitted by the micro-strip set;

wherein the plurality of radiator sets includes a first radiator set and a plurality of second radiator sets disposed in pairs;

wherein radiators included by a pair of the second radiator sets are corresponding in a one-by-one correspondence, and a distance between the pair of second radiator sets equals to a half wavelength of the signal or an at-least-two multiple of the half wavelength of the signal; and wherein the first radiator set is disposed at the center of the plurality of second radiator sets, and a distance between the first radiator set and each of two second radiator sets, which are closest to the first radiator set among the plurality of second radiator sets, equals to an at-least-two multiple of the half wavelength of the signal.

21. The method of claim 20, wherein the plurality of radiator sets are disposed as pairs; and wherein a plurality of radiator sets respectively included by a pair of the radiator sets corresponds to each other in a one-by-one correspondence, and a distance between a pair of radiators from each of the pair of radiator sets equals to a half wavelength of the signal or an at-least-two multiple of the half wavelength of the signal.

22. The method of claim 20, wherein impedance formed by the plurality of radiator sets is conjugate matched to the impedance formed by the micro-strip set, to obtain impedance matching condition.

23. The method of claim 20, wherein the communication device is a transmitter, a receiver, and/or a cell phone.

* * * * *